US006453788B1

(12) United States Patent
Lebet et al.

(10) Patent No.: US 6,453,788 B1
(45) Date of Patent: Sep. 24, 2002

(54) DEVICE FOR ELIMINATING MEANS OF COMBAT

(75) Inventors: Francis Lebet, Uetendorf; Jürg Meister, Steffisburg, both of (CH)

(73) Assignee: SM Schweizerische Munitionsunternehmung AG, Thun (CH)

( * ) Notice: Subject to any disclaimer, the term of this patent is extended or adjusted under 35 U.S.C. 154(b) by 0 days.

(21) Appl. No.: 09/743,334

(22) PCT Filed: Jul. 2, 1999

(86) PCT No.: PCT/CH99/00293

§ 371 (c)(1),
(2), (4) Date: Mar. 12, 2001

(87) PCT Pub. No.: WO00/02002

PCT Pub. Date: Jan. 13, 2000

(30) Foreign Application Priority Data

Jul. 6, 1998 (EP) ..... 98810630

(51) Int. Cl.[7] ..... F42B 33/00

(52) U.S. Cl. ..... 86/50; 89/1.13; 102/306; 102/307

(58) Field of Search ..... 86/50; 89/1.13; 102/306, 307

(56) References Cited

U.S. PATENT DOCUMENTS 5,936,184 A * 8/1999 Majerus et al. ..... 89/1.13

* cited by examiner

*Primary Examiner*—J. Woodrow Eldred
(74) *Attorney, Agent, or Firm*—Schweitzer Cornman Gross & Bondell, LLP

(57) ABSTRACT

To remove means of combat such as mines and unexploded ordnance increasing use is made of hollow charges. Inherent in these is the risk of triggering premature ignition since their liners contain metals. According to the invention a hollow charge (4) suitable for eliminating means of combat is configured largely free of metals and has a liner (3) made of an electrically non-conductive, amorphous material. The material of choice is glass, which when configured correspondingly in addition has a projectile-forming effect and thus raises penetration capability. Apart from lowering environmental pollution the use of metal-free devices also eliminates false alarm messages in metal detectors during mine clearance and therefore significantly improves the safety of mine clearance personnel. The support (16) carrying the hollow charge (4) is fitted with a ball joint (13, 14), resulting in high adaptability to the place of use and type of combat means (M) concerned.

11 Claims, 5 Drawing Sheets

DEVICE FOR ELIMINATING MEANS OF COMBAT

The present invention relates to a piece of ammunition having a dentonator in a plastic housing containing a hollow charge for use in the disposal/destruction of explosive objects.

BACKGROUND OF THE INVENTION

The declared aim of numerous countries and humanitarian organizations is to clear the countless minefields scattered over the globe and to dispose of the unexploded bombs still to be found in all former theatres of war.

The earlier practice of detonating mines and unexploded bombs by means of other weapons has proved to be highly dangerous and often also ineffective. Continuing development and the use of proximity fuses, vibration fuses and fuses responding to magnetic-field changes makes the clearing of mines immensely more difficult and increases the cost immeasurably.

Devices of the present general type (DE-C1-36 23 240) and employ a "low order" technique, i.e. the piercing power of a blast—forming hollow charge mounted e.g. on a tripod is adapted to the casing of the piece of ammunition to be disarmed so that the hollow charge pierces the latter in a controlled manner without initiating it. In this way, the piece of ammunition can be disposed of relatively safely by removal of the explosive charge or by combustion thereof.

However, the necessary adaptation of the piercing power is problematic because this can only be done empirically, either by means of different charges or, as known from DE-C1-36 23 240, by the selective attachment of metal (in practice brass) components reducing the blasting power. Although the known device has a relatively low metal content, a further metal is introduced into the system by way of the attached component in addition to the metal lining, which can cause the piece of ammunition to detonate when modern detonators are brought close and, at least in the case of relatively large minefields, causes lasting damage to the soil by burdening it with heavy metals. In addition, the expense of clearing, often in locations which are accessible only with difficulty, is great owing to the necessary adaptation of the blasting power to the object to be cleared and requires additional logistics.

GB-A-2 254 402 discloses a cutting charge encapsulated in a plastic housing so as to be water-tight and designed principally for marine-technology applications. The lining used is the preferred lining and comprises a ductile, high-density material such as copper. However, the also mentioned possibility of using plastic, ceramic or glass is at the same time rejected because these have the tendency to pulverize on detonation. Owing to its linear cutting blast, a cutting charge is fundamentally unsuitable for the disposal of weapons: its piercing power is too low.

A break-up charge (AT-B-398 634) with a tripod for simplified vertical positioning of the charge has insertion openings in which rod-type feet of various lengths are held by friction. The disadvantage is that the angular position of the break-up charge is not adjustable, with the result that the effectiveness of the charge is at the very least impaired, depending on the ground and the size of the piece of ammunition to be destroyed.

An improved tripod is described in U.S. Pat. No. 5,210,368. The height of this tripod can be adjusted so that the detonator of the piece of ammunition to be destroyed can be triggered by remote control. The relatively low height above the ground and the limited rotatability relative to the respective horizontal plane prevents its use in accordance with the low order technique.

U.S. Pat. No. 5,301,594 discloses a stationary machine for disarming unexploded bombs, for sampling and sealing. This machine is entirely unsuitable for field use, in particular for clearing mines.

A device according to DE-A1-195 14 122 is suitable for detonating a plurality of objects with simultaneous or sequential, central detonation. This device requires blasting charges to be fixed to the weapon to be destroyed, which in a good many cases is too dangerous and in particular unsuitable for clearing minefields, etc.

With weapons disposal systems or EOD (explosive ordnance disposal systems), there is always the danger of premature triggering during installation in the area of the mines, e.g. caused by the reaction of electromagnetic sensors contained in mines, by the metal parts in the EOD and/or by resulting field changes, in particular by movement of explosive charges with inserted metal linings.

These linings, in particular when they comprise heavy metals, additionally cause further emissions, especially in areas with a high density of mines, and harm the fauna, flora, soil, ground water and surface water quite considerably and permanently.

Surprisingly, a projectile-forming hollow charge with such an amorphous, non-electrically conductive lining can safely detonate mines and unexploded bombs up to a distance of several meters or at least make them safe.

The subject of the invention is advantageously aimed at the target (weapon) by the means attached to a cover and/or the housing, although the actual alignment is carried out by known mechanical and/or optical devices.

It has been shown that low levels of energy are adequate for weapons disposal, namely because in most cases it is sufficient to pierce the housing and/or the detonating chain of the dangerous piece of ammunition by means of a hollow charge rather than having to detonate or at least deflagrate it, as previously thought.

On the basis of this knowledge, relatively large weapons can also be disposed of with little technical and financial expenditure, i.e. can be made safe to the extent that they can be safely destroyed, for example by subsequent controlled combustion.

On the basis of current knowledge, technical glass and also organic glass, ceramics, in particular aluminium oxide, and numerous plastics with relatively high density, such as polytetrafluoroethylene and polypropylene, are suitable as materials for the linings. The concept of a non-electrically conductive, amorphous material, i.e. an electrical non-conductor, also includes glass mixtures to which metals or metal oxides have been added to an extent that the glasses remain non-conductive and consequently are not detected by conventional metal detectors used for mines and do not trigger the latter.

It has been shown that the effectiveness of amorphous linings is increased by their formation as a projectile-forming charge.

A cup-shaped formation of the lining produces a shaping process during the first 15 cm of its flight, corresponding to an almost ideal shape of a projectile and achieving an extensive piercing effect in the target.

For technical and economical reasons, a lining of glass is preferred.

Linings of ceramic, in particular $A1_2O_3$, have also been tested, but these are uneconomical to manufacture owing to the necessary sintering process and the required finishing process (grinding). The arrangement of a ball-and-socket joint enables the hollow charge to be aimed at the target in the simplest manner.

A support which further increases the versatility of the EOD has proved successful. By means of selectively insertable supporting rods, the height of the EOD can be fixed within broad limits. Predetermined breaking points permit simple adjustment of the supporting rods to the desired height and additionally bring about the desired "disintegration" of the rods on detonation.

The incorporation of supporting ribs inside the housing allows the EOD to be placed directly on the weapon to be destroyed and additionally provides mechanically satisfactory centering of the lining.

The EOD can be assembled particularly easily by means of the structural arrangement comprising an annular groove. A tapered annular groove produces a clamping effect which further simplifies assembly.

The insertion of a detonator into a hollow cylinder is particularly advantageous.

BRIEF DESCRIPTION OF THE DRAWINGS

Embodiments of the invention will be further described in the following with reference to drawings, wherein.

During the clearing of minefields, it has also repeatedly been demonstrated that these heavy metals, even after detonation of the mines, initiate mine detectors and thus cause indication errors. Consequently, the recognition rate during clearing is reduced. As a result, the safety of the mine-clearing personnel is enormously reduced on top of the non-eliminable danger.

Therefore, the object of the present invention is to provide a safely operating device for the disposal of weapons, which does not have the aforementioned disadvantages, is metal-free and allows accurate destruction at a distance from the weapon, i.e. simplified disposal. The EODs to be provided must not contain any substances which could also cause substantial harm to the environment.

At the same time, the subject of the invention must serve to dispose of explosive devices which are not identifiable, for example for reasons of safety. Unexploded bombs must also be detonated safely and in an environmentally-friendly manner and not cause indication errors during mine clearing.

Furthermore, it must be possible to manufacture the device in large batches as inexpensively as possible using known, modern manufacturing means.

The support carrying an EOD must have a high level of adaptability to the site of use and the type of weapon and must also be metal-free.

Moreover, all the materials used should have low relative pernittivity so as not to trigger sensitive electronic sensors responding to general field changes.

Figure 3:
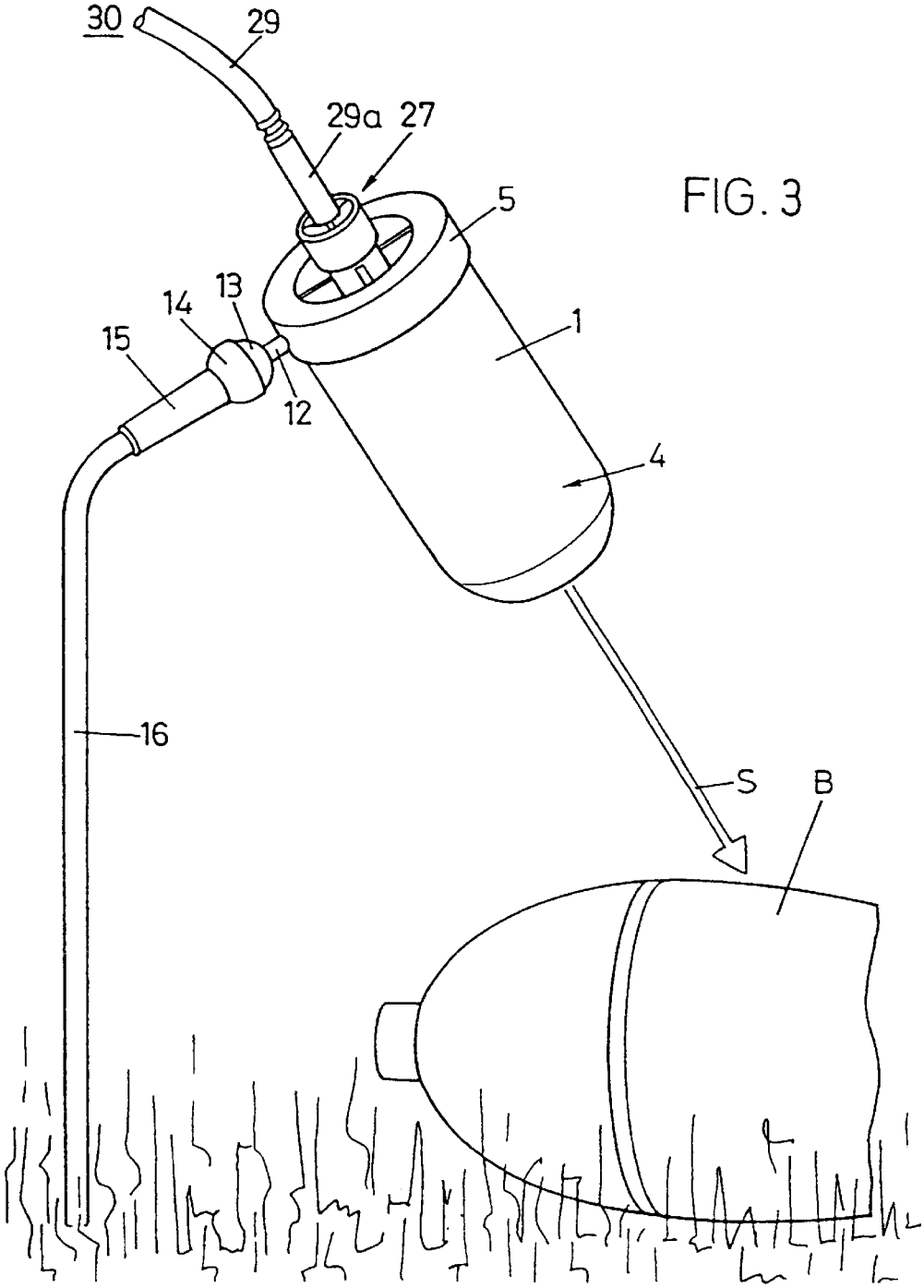

FIG. 3 shows a side view of an electrically initiated hollow charge for the detonation of an unexploded bomb;

BRIEF DESCRIPTION OF THE INVENTION

The objects are achieved by a disposal device of the present invention in the form of a piece of ammunition having a detonator in a plastics housing containing a hollow charge, a lining thereof being supported in the housing, wherein the lining is formed as a projectile-forming charge and comprises a non-electrically conductive amorphous material.

Figure 4:
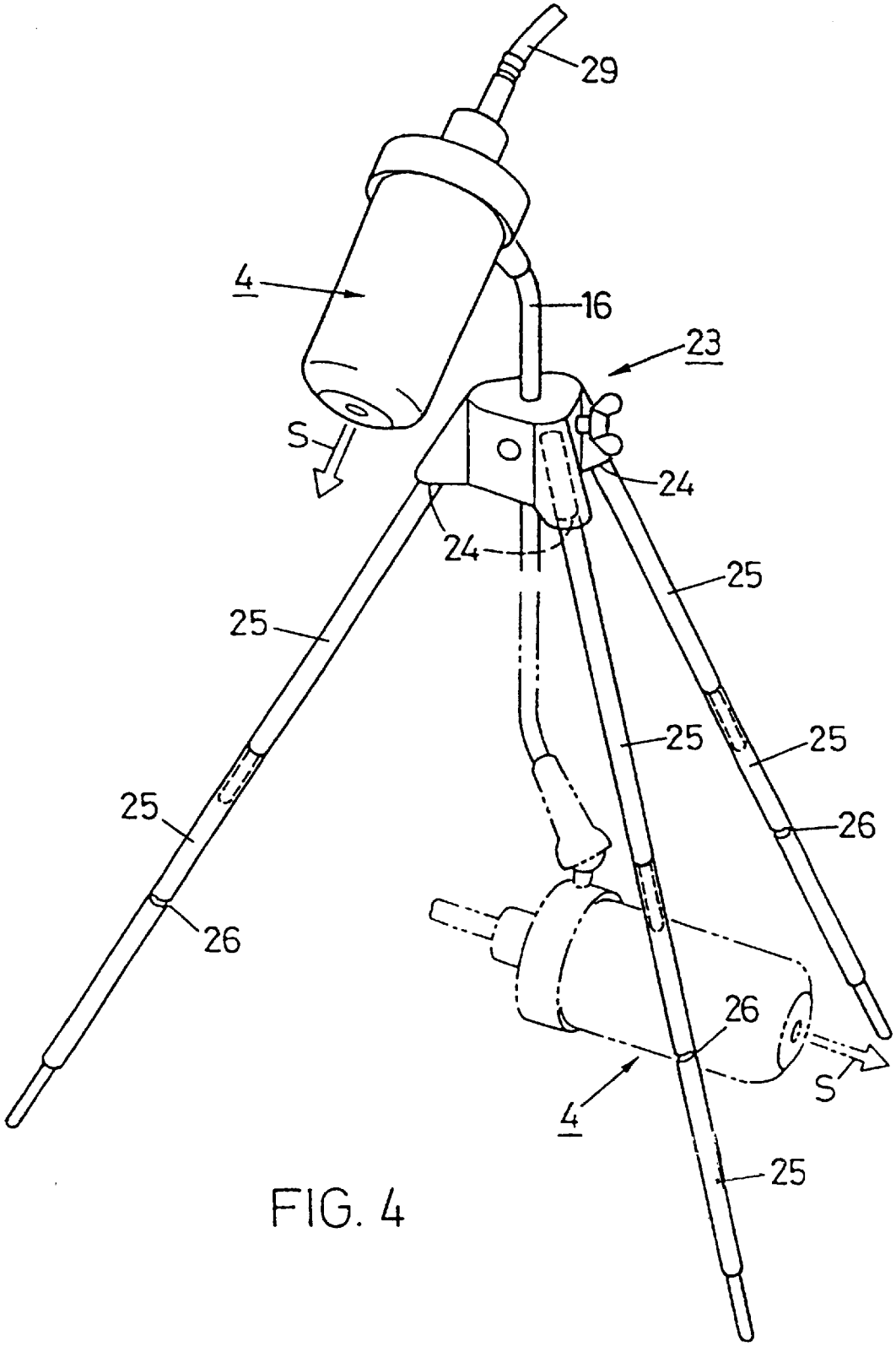
Figure 5:
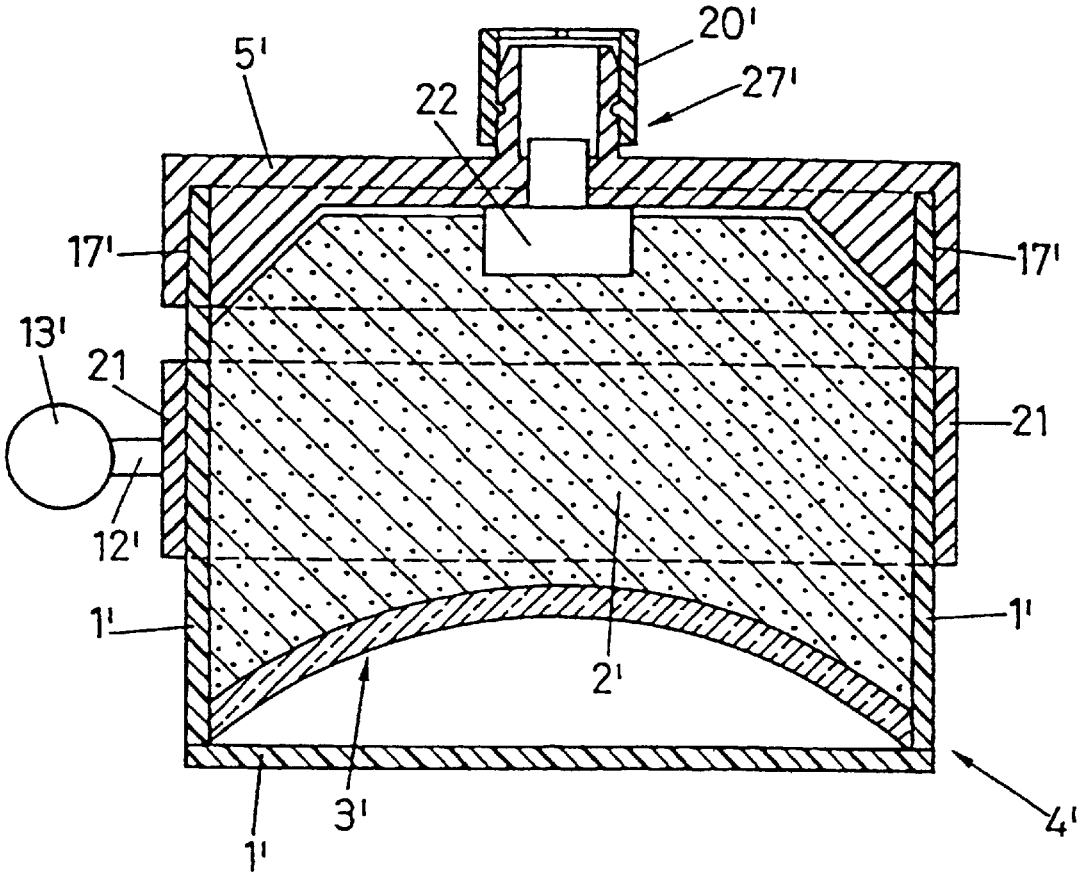
Figure 6:
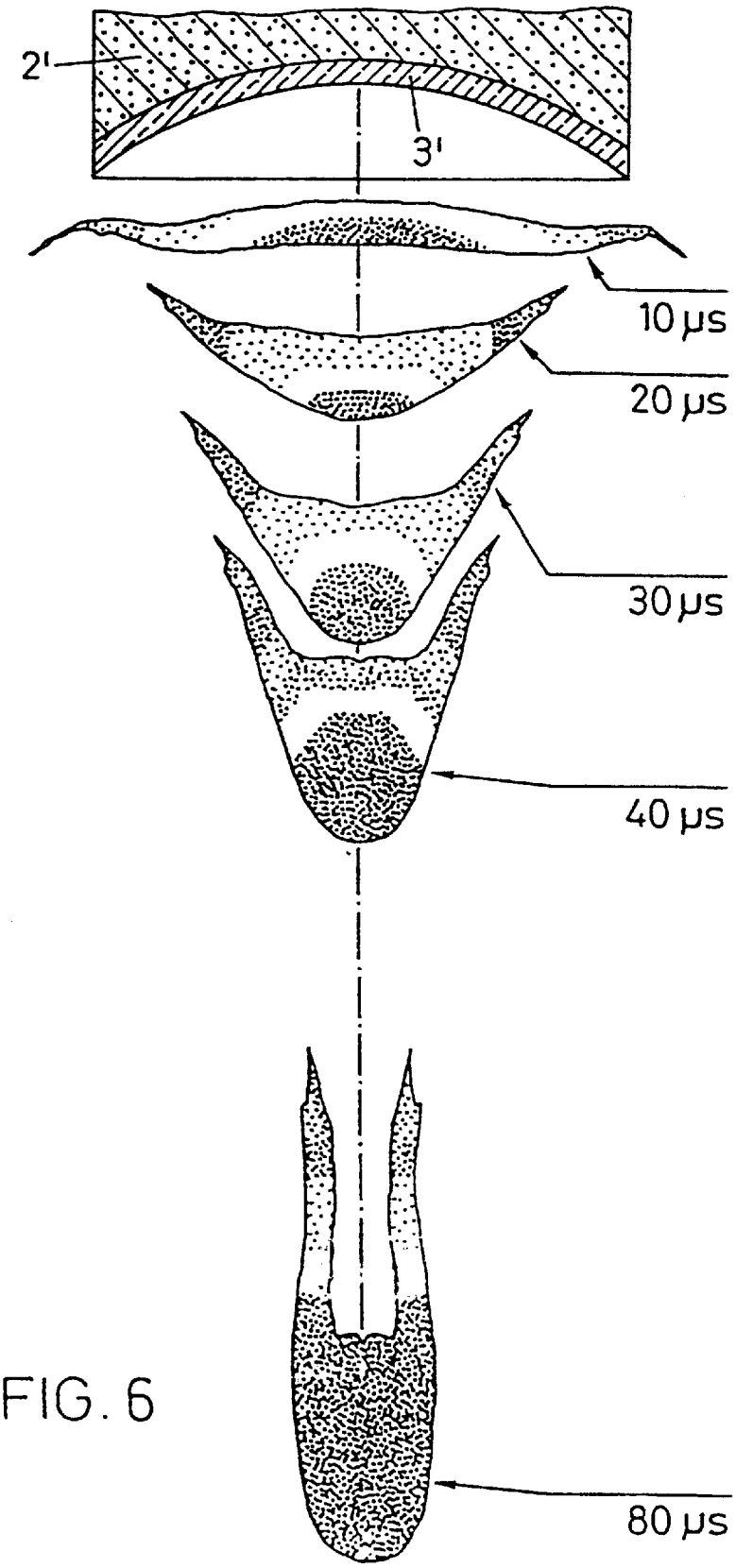

FIG. 4 shows a support with the hollow charge in two schematically shown positions for the disposal of weapons;

FIG. 5 shows a sectional view of a hollow charge having a projectile-forming lining, and FIG. 6 shows a sequential, schematic representation of the projectile formation of the lining according to FIG. 5.

In all the figures, like reference numerals are used for like functional parts.

DETAILED DESCRIPTION OF THE INVENTION

Figure 1:
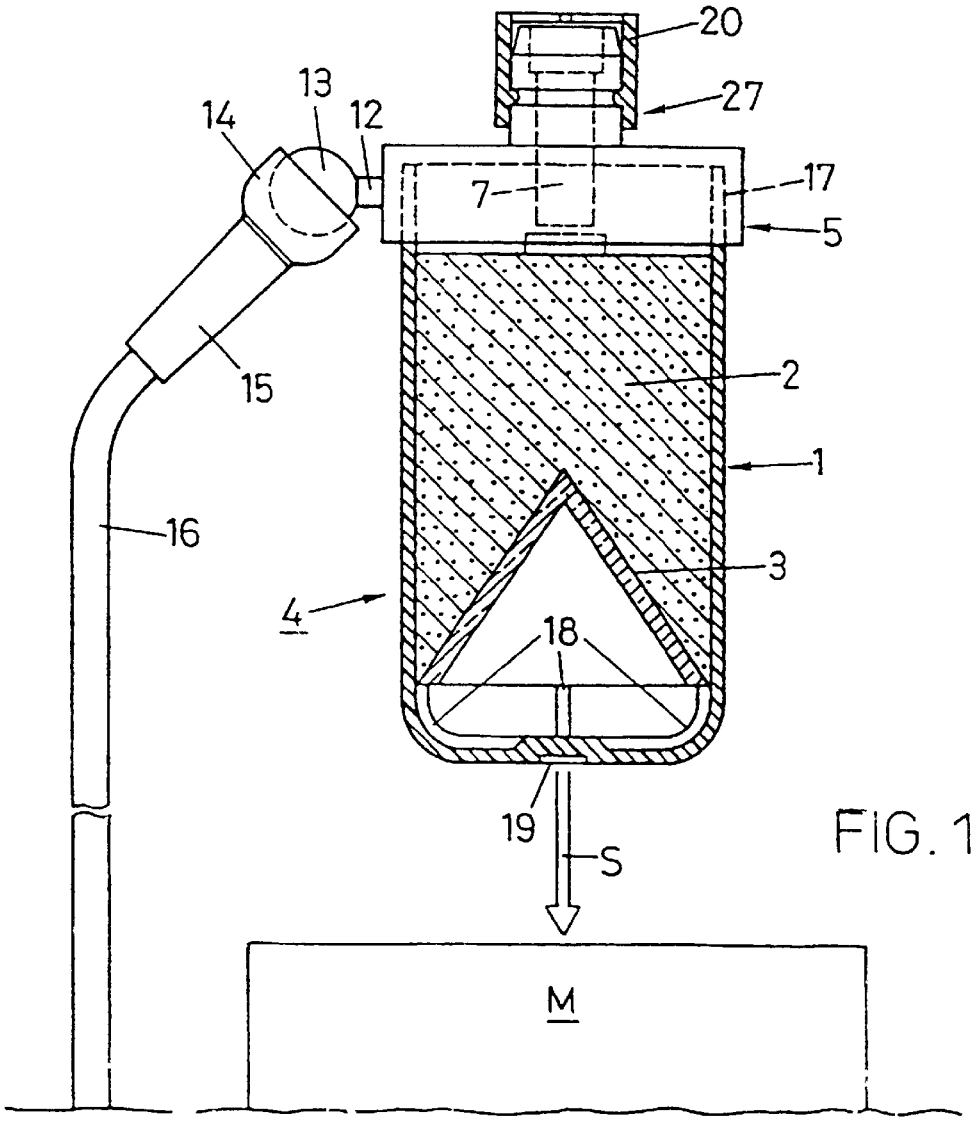
FIG. 1 shows a sectional view of a hollow charge for clearing mines.

In FIG. 1, a plastics housing 1 contains an explosive charge 2 having a conically shaped lining 3 made of glass. The hollow charge 4 thus formed is closed by a cover 5 likewise made of plastics and provided with an annular groove 17 frictionally holding the cylindrical edge of the housing 1. A hollow cylindrical attachment 27, which is covered by a centrally slotted protective cap 20, is arranged above the cover 5 in the axial direction.

A ball support 12 projects from one side of the cover 5 and holds a ball 13 for its part partially enclosed by a socket 14, thereby forming a ball-and-socket joint. The socket 14 merges into a connecting sleeve 15, into which is inserted a rod 16.

Supporting ribs 18, on which the lining 3 is supported at the front end, can be seen in the lower part of the housing 1. The spherical cup of the housing 1 has a frontal predetermined breaking point 19 in the form of a recess.

The blast direction of the hollow charge is designated by S, the schematically shown mine by M.

Figure 2:
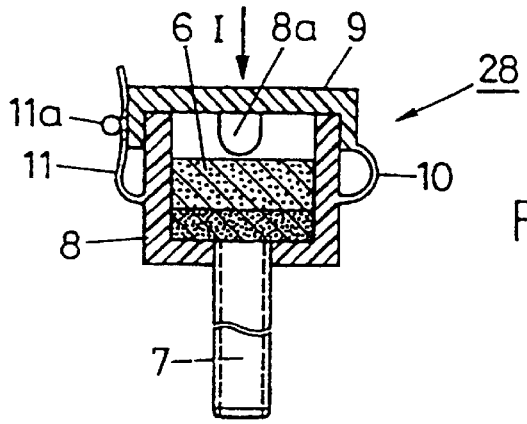
FIG. 2 shows an attachment for pyrotechnically initiated detonation of the hollow charge according to FIG. 1.

Initiation I of the EOD according to FIG. 1 is carried out by inserting a sleeve-type detonating tube 7 of a detonator 28 according to FIG. 2 into the slotted protective cap 20 of the hollow cylindrical attachment 27. The cavities in the detonator 28 and the detonating tube 7 are filled with a conventional secondary explosive such as hexogen or octogen and drive the detonation axially symmetrically into the explosive charge 2.

Above the detonating tube 7 is arranged a known detonating capsule 6 which is laterally held and secured in the detonator housing 8.

The hollow charge 4 according to FIG. 1 is initiated by inserting a detonating fuse into two opposing lateral recesses 8*a* in the detonator housing 8. For this purpose, a strap 11 is pulled away from a nipple 11*a*, and a cover 9 fixed to a bending strap 10 is opened. After the detonating fuse has been introduced, the cover 9 is closed and the strap 11 is drawn over the nipple 11*a* and thereby secured.

A similar hollow charge 4 is aimed at a bomb B in FIG. 3, although in this case an electrical detonating cable 29 with an electric igniter 29*a* at the end is connected to a remotely placed detonation generator 30.

FIG. 4 shows a support 23 intended to facilitate orientation of the EOD. The support 23 is provided with three bores 24, into which supporting rods 25 of any length and having predetermined breaking points 26 can be inserted.

As can be seen from FIG. 4, the support 23 allows the blast direction S of the hollow charge 4 to be aimed towards the weapon to be destroyed. Through optimum use of the potential blasting power, large objects can also be exploded by means of small EODs, in particular when the blast direction S is aimed towards at least part of the detonating chain of the weapon.

Whereas in FIG. 1 a conical lining 3 made of industrial glass and easy to manufacture is used in conjunction with an explosive charge 2 consisting of a well-known secondary explosive, in FIG. 5 a projectile-forming, cup-shaped lining 3' is provided.

For detonation of the explosive charge 2', also consisting of octogen, an also known booster charge 22 consisting of hexogen (RDX) or octogen (HMX) is used, resulting in improved driving of the detonation wave towards the highest point of the cup of the lining 3'.

The structure of the hollow charge 4' corresponds substantially to that of the above-described hollow charges 4 according to FIG. 1. However, for reasons of stability the ball support 12' and the ball 13' are attached to a circumferential clamping strap 21 on the cylindrical part of the hollow charge 4'.

FIG. 6 shows the temporal progress of the shaping process of the lining 31. It can be seen from this that after 10 $\mu$s only a trace of the cup shape of the lining 3' is left, and after 20 $\mu$s a projectile begins to form, which after 80 $\mu$s, i.e. after a distance of less than 12 cm, already has its final shape and has an extensive piercing effect, i.e. a high level of penetration in the target.

In the embodiments described, commercial plastics were used: the housings 4, 4' are made of glass-fibre-reinforced PBT (polybutylene-terephthalate); the covers 5, 5' are also made of glass-fibre-reinforced PBT; the housing of the detonator 28 is made of PE (polyethylene) and the detonating tube 7 is made of a thin-walled aluminium sheet. Naturally, the detonating tube can also be made of POM (polyoxymethylene).

The support is made of POM and the rods 16 and 25 are made of glass-fibre-reinforced PA6 (caprolactam polyamide).

For the detonation of anti-tank mines and other relatively large weapons from distances of several metres, relatively large EODs have proved successful, for example of 66 mm calibre. These were placed on commercial camera or video tripods and aimed at the target over open sights (of a plastics strip).

In principle, all conceivable non-metallic, amorphous materials are suitable for linings, although their economicalness and/or their density set limits.

Linings made of technical glass (industrial glass) have proved to be optimum because they can be manufactured inexpensively by a simple pressing process and are of a density which produces an adequate piercing effect in the target.

Because, for logistical reasons, numerous mines of the same type are planted in a given minefield, it is recommended for economical reasons to use an EOD of which the calibre and lining are adapted to the minimum necessary effect on the target. To increase the density and with it the piercing effect, further known substances can be added to the glass. In addition to strontium, tellurium and minimal quantities of thallium also appear to fulfil the task.

Naturally, the subject of the invention is not limited to use in clearing mines, etc. Civil applications are also possible, e.g. in connection with safety measures for pressure vessels, pipelines, etc., i.e. in all cases where dangerous contamination by metals must not occur.

The subject is also suitable for the remote-controlled detonation of unidentified sabotage objects such as "explosive packages" etc. and can easily be arranged on appropriate vehicles, from which they can be aimed and detonated.

What is claimed is:

1. A device for the disposal of an explosive object by producing in the explosive object an entrance opening into the explosive object and introducing into the explosive object a destructive mechanism, comprising a piece of ammunition having a detonator in a plastic housing containing a hollow charge, a lining of the housing being supported in the plastic housing at a front end of the housing and an adjustable support mounted to the housing for aiming the piece of ammunition at the weapon to be disposed of, the lining being formed as a projectile-forming charge and comprising a non-electrically conductive, amorphous material acting both to create the entrance opening and serving as the destructive mechanism without the introduction into the explosive object of auxiliary reactive materials.

2. A device according to claim 1, wherein the lining is cup-shaped.

3. A device according to claim 1 or 2, wherein the lining is made of glass.

4. A device according to claim 1 or 2, wherein the lining is made of ceramic.

5. A device according to claim 1 or 2, wherein the adjustable support has a ball projecting from a cover of the plastic housing and, together with an attached socket, form a ball-and-socket joint connected to a rod.

6. A device according to claim 5, further comprising a further support into which the rod with the ball-and-socket joint can be positively inserted and fixed.

7. A device according to claim 6, wherein the further support has three supporting rods mounted in bores located in the further support.

8. A device according to claim 7, wherein the three supporting rods have predetermined breaking points over a major part of their lengths.

9. A device according to claim 1 or 2 wherein the lining is supported by supporting ribs arranged inside the housing at the front end.

10. A device according to claim 5, wherein the cover has an annular groove into which a cylindrical part of the housing is inserted.

11. A device according to claim 5, wherein the cover has a hollow cylindrical attachment into which the detonator is insertable.

* * * * *